United States Patent [19]

Burnett

[11] 4,193,168

[45] Mar. 18, 1980

[54] STOP MOTION AND CONDITION RESPONSIVE APPARATUS FOR CARDING MACHINES

[76] Inventor: James H. Burnett, 5300 Augusta Rd, Apt. 160, Greenville, S.C. 29605

[21] Appl. No.: 858,105

[22] Filed: Dec. 7, 1977

[51] Int. Cl.[2] ..... D01G 31/00

[52] U.S. Cl. ..... 19/0.25; 192/125 A; 200/61.13; 226/11

[58] Field of Search ..... 19/0.2, 0.22, 0.23, 19/0.25, 0.26; 192/125 A, 126, 127; 226/10, 11; 200/61.13, 61.18

[56] References Cited

U.S. PATENT DOCUMENTS

| | | | |
|---|---|---|---|
| 1,512,267 | 10/1924 | Arnold | 19/105 |
| 1,559,282 | 10/1925 | Santos | 192/126 |
| 2,270,720 | 1/1942 | Thompson | 19/0.25 X |
| 2,554,104 | 5/1951 | Hand | 19/0.25 X |
| 3,092,875 | 6/1963 | McLean | 19/0.23 |
| 3,191,236 | 6/1965 | Blomquist | 19/0.25 |
| 3,199,151 | 8/1965 | Bird | 19/0.25 |
| 3,251,093 | 5/1966 | Maynard et al. | 19/0.25 X |
| 3,270,374 | 9/1966 | Yon | 19/0.25 |
| 3,380,125 | 4/1968 | Yarga | 19/0.25 |
| 3,462,798 | 8/1969 | Groce | 19/0.25 |
| 4,095,062 | 6/1978 | Sauageau | 200/61.13 |

FOREIGN PATENT DOCUMENTS

| | | | |
|---|---|---|---|
| 1954873 | 12/1970 | Fed. Rep. of Germany | 19/0.26 |
| 651593 | 10/1928 | France | 19/0.25 |
| 283 of 1875 | | United Kingdom | 19/0.25 |

*Primary Examiner*—Louis Rimrodt

*Attorney, Agent, or Firm*—Bailey, Dority & Flint

[57] ABSTRACT

A stop motion apparatus is disclosed for disengaging a drive motion on a carding machine in response to the detection of a desired operating condition wherein the carding machine is of the type having motorized drive means for imparting a drive motion to the carding machine when engaged and actuator means for selectively enaging or disengaging the drive motion. The stop motion apparatus includes a base for attachment to the carding machine and a pivotable arm assembly carried by the base. A linkage assembly connects the pivotable arm assembly to the actuator means of the carding machine. The pivotable arm assembly has a first position in which the actuator means disengages the drive stopping the carding machine and a second position in which the actuator means engages the card drive. A unique cam-lock assembly is provided for locking the pivotal arm assembly in the second position maintaining the drive motion engaged, and a release mechanism is provided for releasing the cam lock assembly allowing the pivotable arm assembly to move to its first position. Various condition responsive devices are disclosed for detecting a desired condition on the carding machine and actuating the release mechanism.

19 Claims, 8 Drawing Figures

STOP MOTION AND CONDITION RESPONSIVE APPARATUS FOR CARDING MACHINES

BACKGROUND OF THE INVENTION

The invention relates to textile carding machines and, in particular, to stop motion apparatus and condition responsive devices for detecting conditions of operation of the carding machine and for interrupting the drive motion of the carding machine in response thereto.

In a typical carding machine, a web or lap is processed in a carding operation to produce a sliver for subsequent processing into textile yarn. The lap is generally in the form of a web of textile material wound on a lap pin which is supported on the carding machine for unwinding and feeding to a main cylinder where it is carded. The textile material is removed from the carding cylinder by a doffer cylinder which rotates closely adjacent the carding cylinder on the end opposite the lap roll. The doffer cylinder is normally driven by a take-off from the main drive of the carding cylinder through a production gear. The production gear is engaged and disengaged with a ring gear mounted on the shaft of the doffer cylinder by means of raising and lowering a drop lever on which the production gear is carried. Other drive arrangements are also utilized. The lap roll is normally driven by a take-off from the doffer cylinder. The web of textile material removed by the doffer cylinder is subsequently drawn therefrom and condensed into a sliver which is deposited into a coiler can for transportation and further processsing. It is important that a uniform weight and quality of sliver be deposited in the coiling can.

During drawing of the sliver from the carding machine, breakage of the sliver often occurs in which case it is necessary to stop the drive motion of the carding machine.

Various devices have been heretofore proposed for sensing the weight of sliver and the breakage of sliver as it is delivered from the carding machine to the coiler can and for stopping the card in response thereto. U.S. Pat. No. 3,270,374 discloses a card stop motion wherein compressed air is utilized to shift a drive belt from a drive pulley to an idler pulley to stop the card in response to the detection of certain sliver conditions. U.S. Pat. No. 3,191,236 shows a mechanical stop motion for a card which utilizes a sliver sensing rod for mechanically actuating a linkage assembly which, in turn, actuates the drop lever of the carding machine which engages and disengages a production drive gear. U.S. Pat. No. 3,199,151 discloses an electro-mechanical stop motion device for a cotton card wherein the sliver is passed through an eye of a pivotable sliver sensing rod which actuates a solenoid in response to sliver breakage. The solenoid withdraws a pin from a notch formed in a spring-loaded plunger releasing the spring-loaded plunger to rotate a belt shifting fork to cause a drive belt to be shifted from a drive pulley to an idler pulley. However, the linkage assembly of the above mechanical devices often are insensitive to the detection of sliver conditions and are easily made unresponsive when the various linkage elements become bent or out of adjustment.

Another condition to which attention need be given in operating a carding machine is the condition of the lap roll. It is desirable to stop the motion of the carding machine and not feed the tail end of the lap to the carding cylinder. The tail end of the lap is normally quite different in its physical characteristics and often includes a double lap of material which, if fed to the main carding cylinder, can result in damage to the clothing of the main cylinder as well as produce inferior sliver if carded. U.S. Pat. No. 3,462,798 discloses a pivotal lever which detects the vertical movement of the lap pin in order to stop the card before the tail of the lap is fed. However, the pivotal lever pin easily becomes bent out of adjustment stopping the card prematurely or not at all. Such is also highly susceptible to abuse by the machine operator who bends it out of shape so as not to be bothered by its maladjusted operation.

Another condition to which considerable attention need be given is the condition of the doffer cylinder. Lap-up of a web material about the doffer cylinder can occur resulting in damage to the metallic clothing of the doffer cylinder and main carding cylinder and physical injury can result if the hands of the operator are caught between the doffer cylinder and doffer shield in attempting to prevent lap-up.

SUMMARY OF THE INVENTION

It has been found that improved stop motion and condition responsive apparatus can be provided for disengaging a drive motion on a carding machine in response to the detection of a desired condition. The apparatus of the invention has application to carding machines of the type having a main carding cylinder, a lap roll which includes a lap pin about which a web of textile material is wound for being fed to the main carding cylinder with the lap pin having opposing ends received in vertical lap pin slots formed within spaced lap stand plates carried on the carding machine. A doffer cylinder is carried next to the carding cylinder for removing textile material from the carding cylinder. A motorized drive imparts a drive motion to the lap roll and the doffer cylinder when engaged and an actuator lever means selectively engages or disengages the drive motion. The apparatus includes a base plate for attachment to the carding machine and a pivotable arm assembly carried by the base. Linkage means is provided for connecting the arm assembly to the actuator means of the carding machine wherein the pivotable arm assembly has a first position in which the actuator means is disengaged and a second position in which the actuator means is engaged. A unique cam-lock assembly is provided for locking the pivotable arm assembly in its second position and a release means is provided for releasing the cam-lock assembly in response to the detection of a desired condition allowing the pivotable arm assembly to move to its first position. Various condition responsive means are provided for detecting the desired condition and include switch means for actuating the release means.

In one form, a condition responsive device includes a vertical plunger carried in a bottom of the vertical lap pin slot for engagement with the lap pin which actuates the switch means in response to vertical movement of the lap pin. In another form, a condition responsive device includes an elongated shield member extending generally across the width of the doffer cylinder and pivotably mounted closely adjacent the surface thereof for pivotable movement in a direction of rotation of the doffer cylinder whereby any lap buildup or entrapment of a hand between the doffer cylinder and shield causes pivotable motion which actuates the release means stopping the drive motion. In another form, the condition responsive device is in the form of an improved sliver detecting rod mechanism.

Accordingly, an important object of the present invention is to provide an improved stop motion apparatus for stopping the drive motion of a carding machine in response to the detection of a desired condition.

Another important object of the present invention is the provision of stop motion and condition responsive apparatus for stopping the card in response to a number of operating conditions which reduces wastes due to sliver breaks and early lap removal and eliminates reclothing of the cylinders due to the feeding of double folds to the card or lap-ups on the doffer.

Yet another important object of the present invention is to provide a stop motion apparatus for holding the drive motion of a carding machine engaged through a unique cam and roller mechanical linkage assembly as long as a solenoid is actuated.

Yet another important object of the present invention is to provide stop motion apparatus for a carding machine which includes a manually operable lever for initially engaging the drive motion of a carding machine which is automatically returned to an idle position preventing sudden kickback of the lever when the drive motion is disengaged by the stop motion apparatus eliminating the possibility of physical injury to the operator.

Yet another important object of the present invention is to provide stop motion apparatus and condition responsive devices which eliminate the opportunity for the operator of the carding machine to bypass the stop motion controls.

Still another important object of the present machine is to provide stop motion and condition responsive apparatus for carding machines having mechanical components which are not readily bent out of shape or otherwise made out of adjustment.

Still another important object of the present invention is to provide a condition responsive device for use with stop motion apparatus for sensing lap-up of a textile web about the doffer cylinder and for preventing engagement of the hand between the doffer cylinder and bonnet.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming part thereof, wherein an example of the invention is shown and wherein.

DESCRIPTION OF A PREFERRED EMBODIMENT

The drawings illustrate stop motion and condition responsive apparatus for detecting certain operating conditions of a carding machine and disengaging a drive motion on the carding machine in response thereto. Since the carding machine itself and the particular drive motion for such machines are well known, only so much of a carding machine as is necessary to an understanding of the invention is illustrated in detail. The details of a typical carding machine and drive motion are disclosed in U.S. Pat. No. 1,512,267. The application of the invention to carding machines having different types of drive arrangements will be readily apparent to one skilled in the art.

Figure 1:
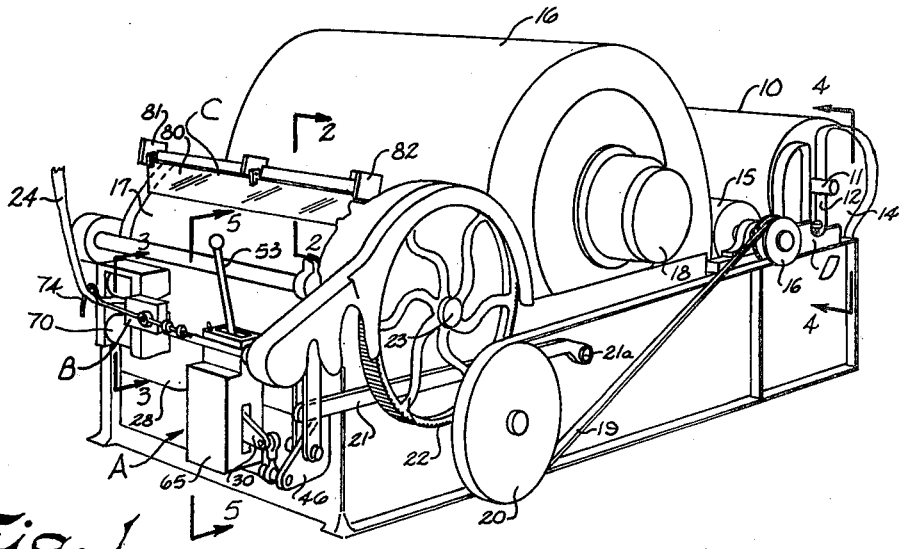
FIG. 1 is a perspective view illustrating a textile carding machine which is equipped with stop motion and condition responsive apparatus according to the invention.

Accordingly, FIG. 1 illustrates a conventional carding machine which is equipped with stop motion apparatus and condition responsive devices according to the invention with only so much of the carding machine illustrated as is necessary to an understanding of the invention. Conventional flats which travel about the main carding cylinder have been omitted since they form no part of the invention herein. The carding machine typically includes a lap roll 10 having a lap pin or rod 11 about which a web of textile material is wound in laps. Opposing ends of the lap pin 11 are achieved in a vertical lap pin slot 12 formed in spaced lap stand plates 14 carried on the sides of the carding machine. The lap roll normally is in contact with a rotating feed roll (not shown) which rotates the lap roll. Adjacent the lap roll is a licker-in 15 having a pulley 16 carried on one end thereof. Adjacent the licker-in 15 is a main carding cylinder to which lap from the lap roll 10 is fed for carding. Adjacent the opposite side of the main carding cylinder 16 is a doffer cylinder 17 which removes the textile material from the carding cylinder 16. The main carding cylinder is typically driven by an electric drive motor 18 and the licker-in 15 is driven off of the shaft of the main carding cylinder by a belt and pulley arrangement. The doffer cylinder 17 is typically driven from the pulley 16 on the rotating licker-in by means of a belt 19 and pulley 20 through a production gear (not shown) which is mounted coaxially and driven with the pulley 20. The production gear is normally carried by a bracket on a drop lever 21 which pivots about a pin 21*a* and serves as an actuator member for engaging and disengaging the drive motion of the doffer cylinder and the feed roll. When the lever 21 is raised, the production gear rotating with pulley 20 is caused to mesh with a gear 22 carried on one end of the shaft 23 of the doffer cylinder. When the drop lever 21 is dropped downwardly, the production gear drops out of engagement with the gear 22 stopping rotation of the doffer cylinder causing interruption of the drive motion of the feed roll 8 and thus the rotation of the lap roll 10. As mentioned previously, a more detailed description of a typical carding machine and drive motion therefor can be had by reference to U.S. Pat. No. 1,512,267. However, it will be understood from the above that the drop lever 21 which pivots about the shaft 21*a* on the side of the carding machine is common to almost all types of carding machines regardless of the type drive employed for controlling the engagement and disengagement of the drive motion for the feeding and doffing of the main carding cylinder 16. It is for this reason that the preferred embodiment of the stop motion apparatus, according to the invention, is illustrated as operating on the actuation lever 21.

As illustrated in FIG. 1, the carding machine is equipped with stop motion and condition responsive apparatus according to the invention for disengaging the drive motion on a carding machine in response to the detection of certain operation conditions of the carding machine. The stop motion apparatus is indicated generally by numeral A and the various condition responsive means for detecting the operating conditions of the carding machine are indicated by numerals B, C and D. The condition responsive device B detects a break or partial break in the sliver 24 and the weight of sliver 24 which exits the carding machine as the web of textile fabric is condensed from the doffer cylinder 17. The resulting sliver 24 is then deposited in a conventional coiler can as is well known. The condition reponsive device C detects a lap-up of the web of textile material on the doffer cylinder 17 in the event that the web of textile material is caused to lap around the roller instead of being drawn therefrom. The condition responsive device C also prevents accidental entrance of a hand of the operating attendant between the doffer cylinder and doffer bonnet when attempting to prevent such lap-up from occurring. It is a natural tendency to try to remove the lap before it enters the space between the doffer cylinder and bonnet and quite often the hand of the attendant will be engaged therebetween causing severe physical injury. The condition responsive device D detects the vertical movement of the lap pin 11 to interrupt the drive motion of the carding machine when the major portion of the lap is removed from the lap roll 10.

Figure 5:
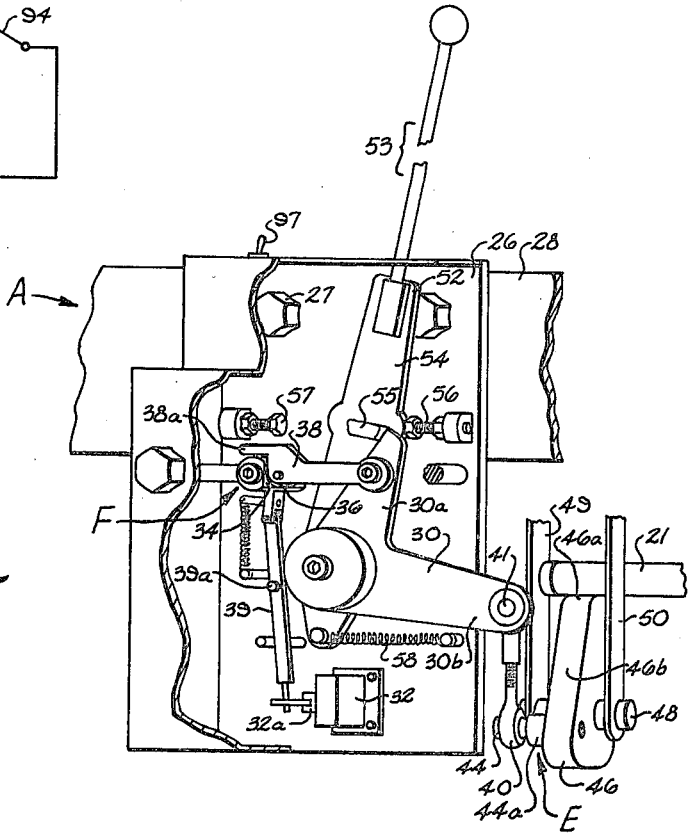
FIG. 5 is a perspective view illustrating a stop motion apparatus according to the invention when in a position in which the drive motion of the carding machine is engaged.
Figure 6:
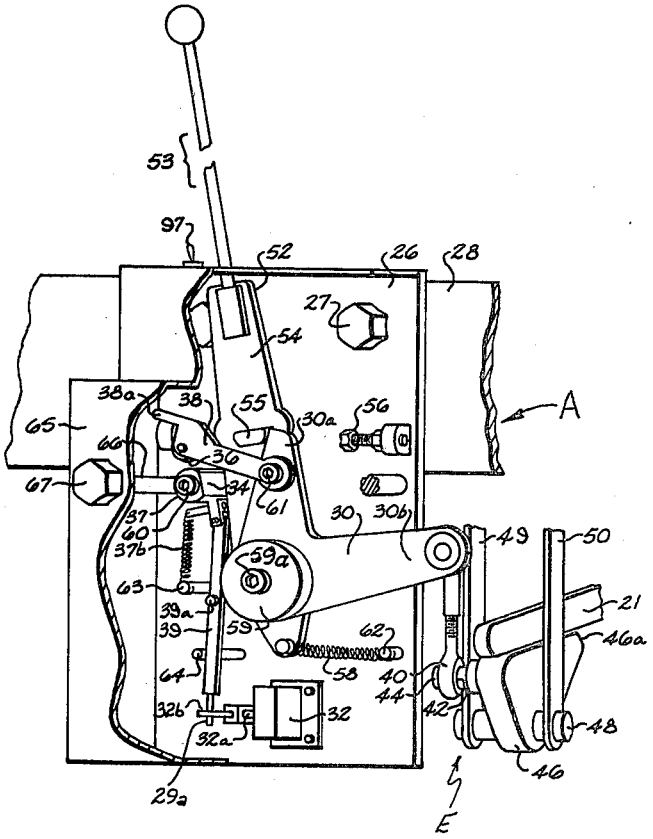
FIG. 6 is a perspective view of the stop motion apparatus of FIG. 5 when in the position in which the drive motion of the carding machine is disengaged.

The stop motion apparatus A will first be described in reference to FIGS. 5 and 6 wherein details of the apparatus are illustrated as including a base means in the form of a back plate 26 which is preferably attached by conventional bolts 27 to a front plate 28 of the carding machine. A generally L-shaped pivotable arm assembly 30 is pivotably carried by the base 26 and includes a first arm portion 30*a* and a second arm portion 30*b*. Linkage means E connects the pivotable arm assembly 30 to the actuator means, which is typically in the form of a drop lever 21, for selectively engaging or disengaging the lap roll and doffer drive motion on the carding machine. The pivotable arm assembly has a first position as shown in FIG. 6 in which the forward end of the actuator means 21 is dropped and the drive motion disengaged and a second position in which actuator 21 is raised engaging the drive motion as shown in FIG. 5. With the actuator means 21 in a raised position, the conventional production gear is caused to mesh with the doffer cylinder gear 22 and with the actuator means dropped, the production gear is disengaged with the doffer cylinder gear 22.

A cam-lock assembly is shown generally at F for locking the pivotable arm assembly in its second position (FIG. 5) in which the actuator means 21 engages the production gear with the doffer cylinder gear. A means for releasing the cam-lock assembly F in response to the detection of a desired condition which allows the pivotable arm assembly to move from its second position (FIG. 5) to its first position (FIG. 6) is provided in the form of an electrical solenoid 32 having a movable core 32*a*. The solenoid pulls the core 32*a* to the right when energized whereby the cam-lock assembly F is maintained in engagement, however, de-energizing of the solenoid results in disengagement of the cam-lock assembly as shown in FIG. 6 whereby the pivotable arm 30 rotates in a counterclockwise motion allowing the lever 21 to drop out of its drive engagement position.

The cam-lock assembly F includes a movable cam surface 34 and a roller surface 36 which engage in a locking relationship as best seen in FIG. 5. A cam body 37 is rotatably carried out by the base plate 26 on which the flat cam surface 34 is formed. The cam body has a first position shown in FIG. 5 wherein the cam surface 34 and roller surface 36 are in locking engagement and a second position as shown in FIG. 6 in which the cam body is rotated relative to its first position permitting the roller surface to slide off of the cam surface and disengage therewith. As illustrated, the roller surface 36 is provided by a roller carried adjacent one end of a pivotable finger element 38 which is carried adjacent the end of the arm portion 30*a* of arm assembly 30. Finger element 38 includes an outwardly extending portion 38*a* which rests on an upper surface of the cam body 37 when the roller 36 is engaged with the cam surface 34 preventing the roller surface from sliding downwardly relative to the cam.

The cam body 37 is operatively connected to the release solenoid 32 by a pivotal lever 29 through which the cam is rotated. The lever is pivoted about a pin 39*a* carried by the base plate. One end 29*a* of the lever is received through a slot in a flat extension 32*b* of the core 32*a* of the solenoid and the opposite end of the lever is pivotably connected by a pin to an integral fork portion 37*a* of the cam body 37. A spring 37*b* aids in biasing the cam body to rotate as lever 29 pivots.

Linkage means for connecting the pivotable arm turn-screw member 40 pivotably carried at 41 by the arm 30*b* of the arm assembly 30 in any suitable manner. The opposing end of turn-screw 40 includes an eye bushing 42 in which a spherical ball joint is fixedly journaled for rotational as well as for swivel motion. A shaft 44, secured to the ball joint, is threadably affixed at its opposing end to a cam plate 46 and tightened thereto by a collar nut 44*a*. The cam plate is pivotably supported about a fixed shaft 48 carried between a pair of spaced legs 49 and 50 which are affixed to the carding machine in a conventional manner. The arms 49 and 50 normally carry a pivotable lever which raises and lowers the drop lever 21 on a conventional card. Substitution of the cam plate 46 for the conventional lever actuator may be accomplished by simply removing pin 48 sometimes held by cotter pins.

Cam plate 46 has a minor surface 46*a* on which the drop lever 21 bears when the lever is raised to an engaged position as shown in FIG. 5 and a major cam surface 46*b* on which the drop lever 21 bears as shown in FIG. 6 when in a dropped position disengaging the drive motion of the card. The turnscrew 40 provides for adjustment in the first and second positions of the pivotable arm assembly 30 in which the actuator lever 21 is raised or lowered for engagement or disengagement of the card.

A manually operated lever 52 is provided having a manually operated handle 53 and a lower portion 54 pivotably carried by the base plate 26 about the same axis as pivotable arm 30. The lower portion 54 includes an abutment 55 for engaging the arm portion 30*a* of arm assembly 30. When the lever handle 53 is rotated or pivoted clockwise, the abutment 55 engages and rotates the arm assembly 30 clockwise allowing the finger element 38 to rotate downwardly or counterclockwise and, assuming the solenoid is energized whereby cam surface 34 is rotated to its engagement position, the roller 36 and cam surface 34 are engaged. The movement of the lever to its most forward right position is determined by an adjustment limit screw 56. The travel of the lever arm 53 in the opposite direction is limited by the position of an adjustable limit screw 57. It will be noted that following movement of the lever 53 to the right so as to position the arm 30 as shown in FIG. 5, the lever 53 will be returned under the force of a return spring 58 to its left limit position as shown in FIG. 6. This prevents the lever 53 from being suddenly kicked to the left by rotation of arm assembly 30 when released by solenoid 32 in the position of FIG. 6. The adjustable limit screws 57 and 56 define first and second limit positions for the lever 53, respectively.

The pivotable arm assembly 30 and lever 53 are secured to the base 26 by means of a spindle which may be press fitted into the back of plate 26 and having internal threads in the free end thereof for receiving a threaded male plug 58 having a front recess for receiving an Allen-type wrench. A collar washer 59 is received between the head of plug screw 59*a* and the pivotable arm 30. In a like manner, the rotating body 37 is rotatably secured to the base means 26 by means of an internally threaded spindle inserted from the backside and male plug 60 threaded therein. The pivotable finger element 38 is secured to the arm portion 30*a* by means of an internal threaded bolt and threaded male plug 61. A pin 62 secures end of spring 58 and is press fitted in the base plate 26 as are pins 63 and limit pin 64. A cover 65 is provided for covering the stop motion mechanism and is attached over the base plate 26 by threaded posts 66 and nut members 67.

Figure 3:
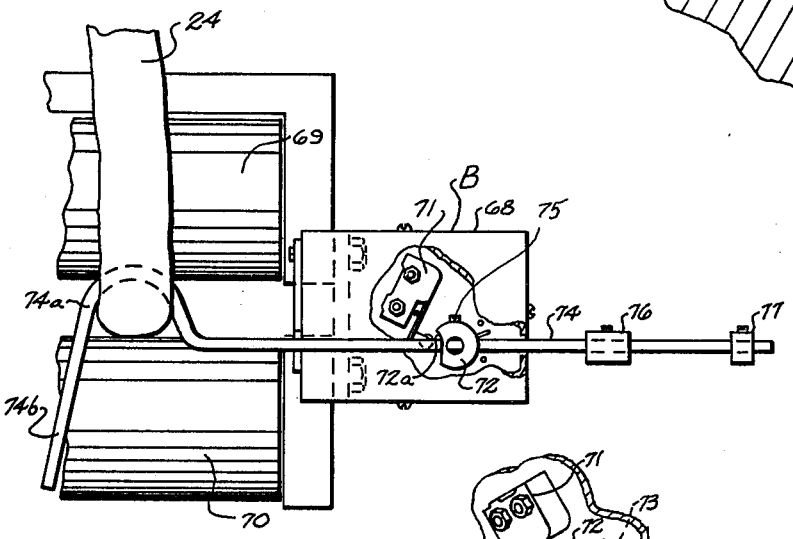
FIG. 3 is an enlarged elevational view taken along line 3—3 of a condition responsive device according to the invention for detecting conditions in the sliver coming from the carding machines.

As illustrated in FIG. 3, the condition responsive device B includes a housing 68 which is bolted onto the side of a pair of calendar rolls 69 and 70 through which the sliver 24 is passed for delivery to the coiler can. A back plate of the housing carries a microswitch 71 having a switching arm 71*a* which carries a roller member 71*b*. A rotatable collar 72 is carried by means of a press fitted spindle 73 fitted in the back of the housing 68 and the collar includes an opening extending transverse to the axis thereof through which a sliver detecting rod 74 is slidably received and set in a desired position by set screw 75. That portion of the collar 72 through which the detection rod 74 extends being extended beyond the outer face of the housing 68. The collar 72 includes a cam surface 72*a* which engages the roller 71 to actuate the switch arm 71*a* of microswitch 71 to an open position when the detection rod 74 pivots counterclockwise a sufficient amount.

Figure 3A:
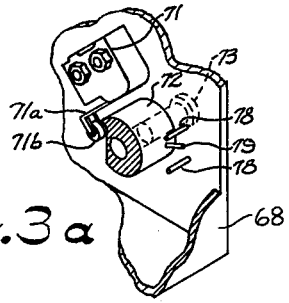
FIG. 3*a* is a perspective cutaway view showing the switch and actuator means therefor of the condition responsive device shown in FIG. 3.

The detection rod 74 is balanced so as to detect a predetermined weight of sliver 24 by means of a pair of counterweights 76 and 77 which may be set along the length of the detection rod 74 by means of set screws. By utilizing a pair of counterweights, a more sensitive adjustment of the sliver detection rod 74 may be had which not only will sense a break in the fiber, but also will sense a reduction in the weight of the sliver or a partial sliver break by detecting a reduced or thin section in the length of the sliver. As illustrated in FIG. 3*a*, the collar 72 and thus the rod 74 are limited in their pivotable movement by means of a pair of stop pins 78 press fitted into the housing 69 and a cooperating stop pin 79 carried by the collar which engages the stop pins 78 between the extreme positions thereof. The detection rod 74 includes a generally hook-shaped end portion 74*a* for engaging the sliver 24. The hook portion includes the bent section 74*a* and a straight section 74*b* extended therefrom. In practice, the sliver may be passed under the straight section 74*b* instead of the bent section for a more sensitive detection of sliver conditions.

Figure 2:
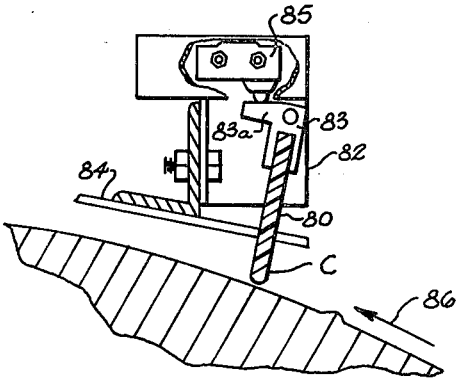
FIG. 2 is a sectional view taken along line 2—2 of FIG. 1.

As illustrated in FIG. 2, the condition responsive device C includes an elongated shield member 80 which extends generally across the entire width of the doffer cylinder 17 and slightly out of contact therewith. Means for mounting the shield member 80 are provided by end brackets 81 and 82 which include a pivotable member 83 which pivotably carries the shield member 80 on the respective brackets closely above the surface of the doffer cylinder. The end brackets are secured by an intermediate bracket 82*a* to a doffer shield or bonnet 84 which covers a portion of the doffer cylinder by means of conventional nut and bolt members. The end bracket 82 includes a microswitch 85 carried adjacent an arm portion 83*a* of the pivotable member 83 whereby pivotable movement of the shield member 80 in the direction of rotation of the doffer cylinder as indicated by arrow 86 causes actuation of the microswitch 85 to an open position. The shield member 80 is preferably formed from a piece of clear plexiglass so that visable inspection may be had behind the shield member.

Figure 4:
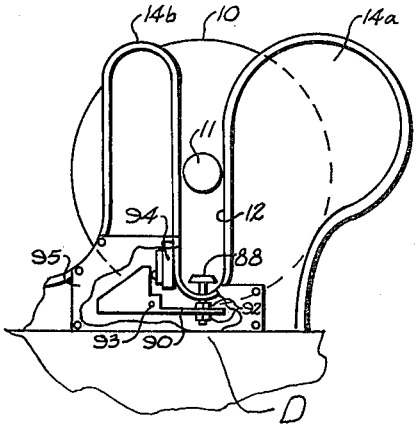
FIG. 4 is an enlarged front elevational view in the direction of line 4—4 with parts broken away illustrating a condition responsive device for detecting the vertical movement of a lap pin according to the invention.
Figure 7:
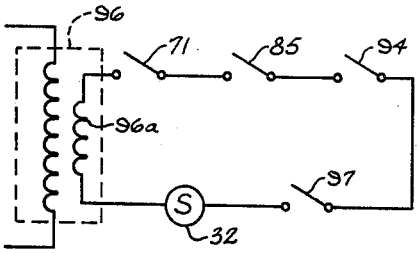

The condition responsive device D is shown in more detail in FIG. 4 as including a vertically movable plunger 88 carried adjacent the lap pin 11 by one of the lap stand plates 14. It is preferred that the vertical plunger 88 be carried in an opening formed in a bottom of the vertical lap pin slot 12 so that the plunger will be essentially tamper-proof by the machine operator. The opposing end of the plunger 88 is adjustably affixed to a lever arm 90 by means of a pair of nut members 92 whereby engagement of the plunger 88 with the lap pin 11 as it moves vertically will pivot the lever arm 90 about a pin 93 so as to actuate a microswitch 94 to an open position. In the illustrated form, the vertical plunger 88 includes a cap having beveled edges and an integral stem portion received through the opening in the bottom end of the lap pin slot. The stem of the plunger 88 being threaded so as to receive the nuts 92. The lap stand plate 14 normally includes a recessed plate face 14*a* and an outwardly extending flange portion 14*b* around the periphery of the lap stand plate which defines the vertical slot 12 and in which the opening is formed for the plunger 88. A cover plate 95 may be provided for enclosing the lever arm 90 and microswitch 94.

In a preferred embodiment, the solenoid 32 is powered by a stepdown transformer 96 which steps down the voltage from the voltage source which drives the electric drive motor 18 of the carding cylinder from approximately 550 volts to 110 volts. One form of a control circuit for the solenoid 32 may consist of a secondary winding 96*a* of the transformer 96 in a series arrangement with the microswitches 70, 85, and 94 along with the solenoid 32 and a manually operated on-off toggle switch 97 carried by the cover 65. Thus, all four switches 70, 85, 94, and 97 would have to be closed before the solenoid 32 would be energized pulling the core thereof to the right as shown in FIG. 5. If an adverse condition were detected by any of the condition responsive devices, the respective microswitch would be actuated to an open position thus de-energizing the solenoid 32 causing the movable core to move to the left and release the cam-lock assembly F as shown in FIG. 6.

To summarize the stop motion and condition responsive apparatus of the present invention, a brief description of the operation will be given. To start up the carding machine, the toggle switch 97 must be first manually closed and with the microswitches 70, 85, and 94 being in a normally closed position, the solenoid 32 will thus be energized pulling the core 32*a* to the right as shown in FIG. 5. The cam body 37 operatively connected to the solenoid will be rotated so that the cam surface 34 is presented in its locking position. Manual lever 53 is then pulled to the right or clockwise toward the limit screw 56 whereupon the abutment 55 engages the arm assembly 30 rotating it clockwise. Clockwise rotation of the arm assembly 30 causes the extended portion 38*a* of finger 38 to drop upon the top of the cam body 37 with the roller 36 positioned against the cam surface 34. When the pivotable arm assembly 30 is rotated, the cam plate 46 is rotated about pin 48 to the position shown in FIG. 5 whereby the drop lever 21 is raised upon cam surface 46*a* causing the production gear carried by the lever to mesh with the doffer cylinder gear 22 engaging the drive motion of the doffer cylinder and the lap roll. Following manual release of the pivotal lever 53, it is automatically returned against limit screw 57 by means of return spring 58. It will be noted that the roller surface 36 will be urged against the cam surface 34 by the downward force exerted by the drop lever 21 against the cam plate 46 which urges the turnscrew member upward exerting a counterclockwise rotational force on the arm assembly 30 locking the roller against the cam surface.

Should one of the operating conditions be detected in either the lap roll 10, the sliver 24 or at the doffer cylinder 17, by one of the condition responsive devices, the corresponding microswitch will be actuated and the circuit of the solenoid will be opened de-energizing the solenoid causing the core 38 to move to the left causing linkage arm 39 to pivot clockwise about the pin 39*a* causing the cam body 37 to rotate counterclockwise permitting the roller 36 to slide past the flat cam surface 34. With the release of finger 38, the pivotal arm assembly 30 rotates counterclockwise under the force of the lever arm 21 bearing down against the cam surface 46*a*. Release of the pivotable arm assembly 30 will allow the lever arm 21 to drop, dropping the production gear out of mesh with the doffer cylinder wheel 22 stopping the drive motion of the doffer cylinder and the lap roll feed. In this position, the drop lever 21 will rest on the major cam surface 46*b* until once again the manual lever 53 is rotated clockwise.

Thus, it can be seen that an advantageous construction can be had for stop motion and condition responsive apparatus according to the invention. The stop motion mechanism is quick to release and stop the drive motion of the carding machine in response to a number of condition responsive devices while utilizing only a minimum number of moving parts affording a high degree of reliability. Starting of the card and setting of the stop motion mechanism may be had by the simple movement of a single lever which automatically returns to an idle position avoiding sudden kick-back and personal injury. The construction of condition responsive devices according to the invention provides a minimum of moving parts which are easily maintained in adjustment and are not easily susceptible to being bent out of adjustment affording a high degree of sensitivity to detecting the operating conditions on the card. Sliver and lap wasts are reduced as well as reclothing expenses while reducing the likelihood of personal injuries.

While a preferred embodiment of the invention has been described using specific terms, such description is for illustrative purposes only, and it is to be understood that changes and variations may be made without departing from the spirit or scope of the following claims.

What is claimed is:

1. Stop motion apparatus for disengaging a drive motion on a carding machine, said carding machine being of the type having motorized drive means for imparting said drive motion to said carding machine when engaged, actuator means for selectively engaging or disengaging said drive motion, said apparatus comprising:

base means for attachment to said carding machine;

a movable arm assembly carried adjacent said base means;

linkage means for connecting said arm assembly to said actuator means of said carding machine;

said movable arm assembly having a first position in which said actuator means disengages said drive motion and a second position in which said actuator means engages said drive motion;

a cam-lock assembly for locking said pivotable arm assembly in said second position;

said cam-lock assembly including a movable cam surface carried by said base means and a roller surface carried by said movable arm assembly for engaging with said cam surface in a locking relationship when said movable arm assembly is in said second position; and release means for releasing said cam-lock assembly allowing said movable arm assembly to move to said first position.

2. The apparatus of claim 1 comprising:

a cam body rotatably carried by said base means on which said cam surface is carried;

said cam body having a first position wherein said cam surface and roller surface are in locking engagement and a second position in which said cam surface is rotated relative to said first position permitting said roller surface to disengage with said cam surface; and connection means operatively connecting said cam body and said release means causing said cam body to rotate to said second position in response to the detection of said desired condition.

3. The apparatus of claim 1 including manually operable lever means pivotably carried by said carding machine for movement between first and second limit positions, said lever means engaging said movable arm assembly when moved toward said second limit position causing movement of said arm assembly to its second position.

4. The apparatus of claim 3 including return means for automatically returning said lever means to said first limit position subsequent to moving said arm assembly to its second position.

5. The apparatus of claim 1 wherein said release means includes a solenoid and a solenoid actuated member operatively connected to said cam-lock assembly, said solenoid being deactuated in response to the detection of said desired condition.

6. The apparatus of claim 1 including a cam body rotatably carried by said base means with said cam surface being carried thereon, and a finger element movable carried by said pivotable arm assembly, said roller surface being carried adjacent a free end of said pivotable finger element.

7. The apparatus of claim 6 wherein said finger element includes an outwardly protruding portion extending past said roller surface on said free end for contacting an upper surface of said cam body when said cam and roller surfaces are in locking engagement.

8. The apparatus of claim 1 including a cam plate pivotably carried by said carding machine connected to said linkage means, said cam plate having a first cam surface supporting said actuator means when engaged and a second cam surface supporting said actuator means when disengaged.

9. Stop motion apparatus for disengaging a drive motion on a carding machine of the type having a lap roll rotatably driven by said drive motion, said lap roll including a lap pin upon which a web of textile material is wound in laps with opposed ends of said lap pin being received in vertical slots formed in spaced lap stand plates carried adjacent the sides of said carding machine, said apparatus comprising:

stop motion means for terminating said drive motion when actuated;

a condition responsive device for detecting downward movement of said lap pin including a plunger carried by one of said lap stand plates for engagement with said lap pin; and said plunger being slidably carried in a flange portion of said lap stand plate slot and disposed within said slot affording protection against tampering and malfunctioning of said plunger;

switch means carried adjacent said plate actuated by the movement of said plunger for actuating said stop motion means.

10. The apparatus of claim 9 including pivotable lever means carried adjacent said lap stand plate having one end engaging an end of said plunger and a remote end engaging said switch means for actuation thereof.

11. The apparatus of claim 9 wherein said vertically movable plunger is slidably carried in said flange portion at a bottom end portion of said vertical slot.

12. Stop motion apparatus for disengaging a drive motion on a carding machine, said carding machine being of the type having a main carding cylinder, a lap roll including a lap pin about which a web of textile material is wound for being fed to said carding cylinder, said lap pin having opposing ends received in vertical slots formed in spaced lap stand plates carried on said carding machine, a doffer cylinder for removing textile material from said carding cylinder, and said lap roll and said doffer cylinder being rotatably driven by said drive motion when engaged and actuator means for selectively engaging or disengaging said drive motion, said apparatus comprising:

base means for attachment to said carding machine, a movable arm assembly carried adjacent said base means;

linkage means fo connecting said movable arm assembly to said actuator means of said carding machine;

said movable arm assembly having a first position in which actuator means is disengaged and a second position in which said actuator means is engaged;

manually operable lever means carried adjacent said base means engaging said movable arm assembly for moving said movable arm assembly to said second position and releasable thereafter out of engagement therewith;

a cam-lock assembly for locking said pivotable arm assembly in second position;

release means for releasing said cam-lock assembly allowing said pivotable arm assembly to move to said first position; and a condition responsive device including switch means for actuating said release means.

13. The apparatus of claim 12 wherein said condition responsive device includes a plunger carried for vertical movement adjacent one of said lap stand plates for engagement with said lap pin; and switch means carried adjacent said plate actuated by the movement of said plunger for actuating said release means.

14. The apparatus of claim 13 wherein said plunger is carried in a bottom end of a vertical slot of one of said lap stand plates.

15. The apparatus of claim 12 wherein said condition responsive device includes an elongated shield member;

mounting means for mounting said shield member closely adjacent the surface of said doffer cylinder extending generally across the entire width thereof including pivotal means for carrying said shield member for pivotal movement toward the direction of rotation of said doffer cylinder; and switch means carried adjacent said shield member for actuating said release means, said switch means being actuated in response to said pivotal movement of said shield member.

16. The apparatus of claim 15 wherein said shield member comprises an elongated piece of plexiglass.

17. The apparatus of claim 12 wherein said condition responsive device detects a condition in a sliver of textile material produced by said carding machine, said device including:

an elongated sliver detection rod having a generally hook-shaped portion on one end thereof;

at least two counter-weights slidably carried adjacent the opposing end thereof;

means pivotably supporting said detection rod intermediate said opposing ends and for mounting said rod adjacent said sliver as it exits said carding machine; and switch means carried adjacent said detection rod for actuating said release means in response to the pivotal movement of said detection rod.

18. The apparatus of claim 17 wherein said means for pivotably supporting said detecting rod includes a rotatable collar member, said detection rod being axially adjustably carried by said collar member.

19. Stop motion apparatus for disengaging a drive motion on a carding machine, said carding machine being of the type having motorized drive means for imparting a drive motion to said carding machine when engaged and actuator means for selectively engaging or disengaging said drive motion, said apparatus comprising:

base means for attachment to said carding machine;

a movable arm assembly carried adjacent said base means;

linkage means for connecting said arm assembly to said actuator means of said carding machine;

said movable arm assembly having a first position in which said actuator means disengages said drive motion and a second position in which said actuator means engages said drive motion;

a cam-lock assembly for locking said movable arm assembly in said second position;

release means for releasing said cam-lock assembly allowing said movable arm assembly to move to said first position;

said release means including a solenoid and a solenoid actuated member operatively connected to said cam lock assembly; and circuit means including manually operated switch means for energizing said circuit means upon closure thereof and at least one condition responsive switch means connected in series with said solenoid, said solenoid being deactuated in response to the actuation of said condition responsive switch means.

* * * * *